US011293267B2

(12) United States Patent
Boyd et al.

(10) Patent No.: US 11,293,267 B2
(45) Date of Patent: Apr. 5, 2022

(54) APPARATUSES AND METHODS FOR SCRAPING

(71) Applicant: FLOWCO PRODUCTION SOLUTIONS, LLC, Fort Worth, TX (US)

(72) Inventors: Garrett S. Boyd, Granbury, TX (US); Mitchell A. Boyd, Haslet, TX (US)

(73) Assignee: FLOWCO PRODUCTION SOLUTIONS, LLC, Fort Worth, TX (US)

( * ) Notice: Subject to any disclaimer, the term of this patent is extended or adjusted under 35 U.S.C. 154(b) by 0 days.

(21) Appl. No.: 16/698,228

(22) Filed: Nov. 27, 2019

(65) Prior Publication Data

US 2020/0173256 A1 Jun. 4, 2020

Related U.S. Application Data

(60) Provisional application No. 62/876,155, filed on Jul. 19, 2019, provisional application No. 62/773,749, filed on Nov. 30, 2018.

(51) Int. Cl.
*E21B 37/02* (2006.01)
*E21B 43/12* (2006.01)

(52) U.S. Cl.
CPC ..... *E21B 37/02* (2013.01); *E21B 43/121* (2013.01)

(58) Field of Classification Search
CPC ..... E21B 37/02; E21B 37/045; E21B 37/04
See application file for complete search history.

(56) References Cited

U.S. PATENT DOCUMENTS 1,415,788 A 5/1922 Burlin
1,509,386 A 11/1924 Wilson
(Continued)

FOREIGN PATENT DOCUMENTS

CA 2428618 A1 11/2004
CA 2635993 A1 12/2009
(Continued)

OTHER PUBLICATIONS

Bal-Seal, Bal Springtm Canted Coil Springs for Mehcanical Applications, product website, 3 pages, www.balseal.com/mechanical.
(Continued)

*Primary Examiner* — Kipp C Wallace
(74) *Attorney, Agent, or Firm* — Jason P. Mueller; FisherBroyles, LLP

(57) ABSTRACT

Disclosed embodiments include an apparatus, such as a plunger for oil and/or gas wells, that includes one or more scraping features. The scraping feature may include at least one ridge configured to scrape material, such as paraffins, asphaltenes, salt, hydrates, debris, solids, etc., from an inner surface of a tubular body and direct the scraped material away from the plunger body. A disclosed method for scraping material from a tubular body includes releasing a plunger within the tubular body, the plunger having a body with an outer surface and a scraping feature on the outer surface that includes at least one ridge; scraping material from an inner surface of the tubular body with the ridge of the scraping feature; and directing the scraped material away from the plunger body.

22 Claims, 18 Drawing Sheets

(56) References Cited

U.S. PATENT DOCUMENTS 1,910,616 A 5/1933 Leahy
1,932,992 A 10/1933 Sherman et al.
2,018,204 A 10/1935 Seth et al.
2,094,897 A * 10/1937 Leidecker ..... E21B 37/02 166/176
2,175,770 A * 10/1939 Dodson ..... E21B 37/02 166/176
2,215,751 A 9/1940 Coleman
2,295,058 A * 9/1942 Smethers ..... E21B 37/02 166/175
2,301,319 A 11/1942 Peters
2,312,476 A 3/1943 Penick et al.
2,437,429 A 3/1948 Hossfeld
2,509,922 A * 5/1950 Hall ..... E21B 37/045 166/153
2,642,002 A 6/1953 Knox et al.
2,661,024 A 12/1953 Knox
2,676,547 A 4/1954 Knox
2,714,855 A 8/1955 Brown
2,762,310 A * 9/1956 Eklund ..... E21B 37/04 92/193
2,785,757 A * 3/1957 Middleton ..... E21B 37/045 166/170
2,878,754 A 3/1959 McMurry
2,956,797 A 10/1960 Polhemus
2,962,978 A * 12/1960 Reeves ..... E21B 43/12 417/56
2,970,547 A 2/1961 McMurry
3,020,852 A 2/1962 Roach et al.
3,055,306 A 9/1962 Tausch
3,090,315 A 5/1963 Milton
3,127,197 A 3/1964 Kretzschmar
3,146,725 A 9/1964 Harris
3,171,487 A * 3/1965 Ault ..... E21B 37/045 166/66.5
3,181,470 A 5/1965 Clingman
3,304,874 A * 2/1967 Lyles ..... E21B 37/04 417/59
3,395,759 A * 8/1968 Talley, Jr. ..... E21B 37/04 166/155
3,412,798 A 11/1968 Gregston
3,508,428 A 4/1970 Matson, Jr.
3,806,106 A 4/1974 Hamel et al.
3,861,471 A 1/1975 Douglas
3,944,641 A 3/1976 Lemelson
4,018,248 A 4/1977 Carr
4,030,858 A 6/1977 Coles, Jr.
4,211,279 A 7/1980 Isaacks
4,239,458 A 12/1980 Yeatts
4,440,229 A * 4/1984 Burch ..... E21B 17/1078 166/311
4,502,843 A 3/1985 Martin
4,531,891 A 7/1985 Coles, III
4,571,162 A 2/1986 Knox
4,629,004 A 12/1986 Griffin
4,782,896 A 11/1988 Witten
4,896,720 A * 1/1990 DeRouen ..... E21B 33/16 15/104.061
4,932,471 A 6/1990 Tucker et al.
4,951,752 A 8/1990 Coleman
4,995,459 A * 2/1991 Mabry ..... E21B 37/02 166/176
5,218,763 A 6/1993 Marker et al.
5,253,713 A 10/1993 Gregg et al.
5,280,890 A 1/1994 Wydra
5,417,291 A 5/1995 Leising
5,427,504 A 6/1995 Dinning et al.
5,868,384 A 2/1999 Anderson
6,045,335 A 4/2000 Dinning
6,148,923 A 11/2000 Casey
6,176,309 B1 1/2001 Bender
6,200,103 B1 3/2001 Bender
6,209,637 B1 4/2001 Wells
6,234,770 B1 5/2001 Ridley et al.
6,467,541 B1 10/2002 Wells
6,478,087 B2 11/2002 Allen
6,554,580 B1 4/2003 Mayfield et al.
6,637,510 B2 10/2003 Lee
6,644,399 B2 11/2003 Abbott et al.
6,669,449 B2 12/2003 Giacomino
6,725,916 B2 4/2004 Gray et al.
6,745,839 B1 * 6/2004 Simpson ..... E21B 37/04 166/311
6,755,628 B1 6/2004 Howell
6,808,019 B1 * 10/2004 Mabry ..... E21B 37/02 166/176
6,846,509 B2 1/2005 Chen et al.
6,848,509 B2 2/2005 Myerley
6,907,926 B2 6/2005 Bosley
7,040,401 B1 5/2006 McCannon
7,055,812 B2 6/2006 Balsells
7,121,335 B2 10/2006 Townsend
7,290,602 B2 11/2007 Victor
7,314,080 B2 1/2008 Giacomino
7,322,417 B2 1/2008 Rytlewski et al.
7,328,748 B2 2/2008 Giacomino
7,383,878 B1 6/2008 Victor
7,438,125 B2 10/2008 Victor
7,475,731 B2 1/2009 Victor
7,513,301 B2 4/2009 Victor
7,523,783 B2 4/2009 Victor
7,819,189 B1 10/2010 Cosby
7,954,545 B2 6/2011 Hearn et al.
8,181,706 B2 5/2012 Tanton
8,286,700 B1 10/2012 Franchini
8,347,955 B1 1/2013 Sewell et al.
8,448,710 B1 5/2013 Stephens
8,464,798 B2 6/2013 Nadkrynechny
8,627,892 B2 1/2014 Nadkrynechny
8,757,267 B2 6/2014 Mitchell et al.
8,863,837 B2 10/2014 Bender et al.
8,893,777 B1 11/2014 Garrett
9,068,443 B2 6/2015 Jefferies et al.
9,200,489 B1 * 12/2015 Mabry ..... E21B 17/1071
9,677,389 B2 6/2017 Boyd et al.
9,683,430 B1 6/2017 Kuykendall
9,689,242 B2 6/2017 Kuykendall et al.
9,790,772 B2 10/2017 Jefferies et al.
10,018,015 B2 7/2018 Purkis et al.
10,161,230 B2 12/2018 Roycroft et al.
10,221,849 B2 3/2019 Roycroft et al.
10,273,789 B2 4/2019 Boyd et al.
10,550,674 B2 2/2020 Boyd et al.
10,767,679 B2 9/2020 Balsells
2001/0042623 A1 * 11/2001 Reynolds ..... E21B 37/045 166/312
2002/0005284 A1 * 1/2002 Allen ..... F16L 45/00 166/173
2003/0155129 A1 8/2003 Gray et al.
2003/0198513 A1 10/2003 Wang
2004/0017049 A1 1/2004 Fink
2004/0066039 A1 4/2004 Muhammad et al.
2004/0070128 A1 4/2004 Balsells
2004/0129428 A1 7/2004 Kelley
2005/0056416 A1 3/2005 Gray et al.
2005/0241819 A1 11/2005 Victor
2006/0024928 A1 2/2006 Seebauer et al.
2006/0054329 A1 3/2006 Chisholm
2006/0113072 A1 6/2006 Lee
2006/0124292 A1 6/2006 Victor
2006/0124294 A1 6/2006 Victor
2006/0185853 A1 8/2006 Bender
2006/0207796 A1 * 9/2006 Stewart ..... E21B 10/26 175/57
2006/0214019 A1 9/2006 Ollendick
2006/0249284 A1 11/2006 Victor
2007/0110541 A1 5/2007 Rawlins et al.
2007/0124919 A1 6/2007 Probst
2007/0151738 A1 7/2007 Giacomino
2007/0158061 A1 7/2007 Casey
2008/0029271 A1 2/2008 Bolding et al.
2008/0029721 A1 2/2008 Miyahara
2009/0229835 A1 9/2009 Filippov

(56) References Cited

U.S. PATENT DOCUMENTS

| | | | | |
|---|---|---|---|---|
| 2009/0308691 | A1 | 12/2009 | Commins et al. | |
| 2010/0038071 | A1 | 2/2010 | Scott et al. | |
| 2011/0253382 | A1 | 10/2011 | Nadkrynechny | |
| 2011/0259438 | A1 | 10/2011 | Osborne | |
| 2012/0036913 | A1 | 2/2012 | Johnson | |
| 2012/0204977 | A1 | 8/2012 | Lembcke | |
| 2012/0304577 | A1 | 12/2012 | Reid et al. | |
| 2012/0305236 | A1 | 12/2012 | Gouthaman | |
| 2012/0318524 | A1 | 12/2012 | Lea, Jr. | |
| 2013/0020091 | A1 | 1/2013 | Maerz | |
| 2013/0133876 | A1 | 5/2013 | Naedler et al. | |
| 2014/0090830 | A1 | 4/2014 | Maerz et al. | |
| 2014/0116714 | A1 | 5/2014 | Jefferies et al. | |
| 2014/0131107 | A1 | 5/2014 | Southard | |
| 2014/0131932 | A1 | 5/2014 | Balsells et al. | |
| 2014/0230940 | A1 | 8/2014 | Patton | |
| 2015/0027713 | A1* | 1/2015 | Penisson | E21B 37/02 166/311 |
| 2015/0136389 | A1 | 5/2015 | Bergman | |
| 2015/0167428 | A1 | 6/2015 | Hofman et al. | |
| 2015/0316115 | A1 | 11/2015 | Carter | |
| 2016/0010436 | A1 | 1/2016 | Boyd | |
| 2016/0061012 | A1 | 3/2016 | Zimmerman, Jr. | |
| 2016/0061239 | A1 | 3/2016 | Heaphy et al. | |
| 2016/0108710 | A1 | 4/2016 | Hightower et al. | |
| 2016/0238002 | A1 | 8/2016 | Williams et al. | |
| 2016/0245417 | A1 | 8/2016 | Boyd et al. | |
| 2017/0058651 | A1 | 3/2017 | Damiano et al. | |
| 2017/0107802 | A1 | 4/2017 | Kuykendall et al. | |
| 2017/0107803 | A1 | 4/2017 | Cedillo et al. | |
| 2017/0122084 | A1 | 5/2017 | Brewer et al. | |
| 2017/0268318 | A1 | 9/2017 | Roycroft et al. | |
| 2017/0362917 | A1* | 12/2017 | Esslemont | B24B 5/40 |
| 2018/0355695 | A1* | 12/2018 | Holland | E21B 33/1208 |
| 2019/0203570 | A1 | 7/2019 | Boyd et al. | |

FOREIGN PATENT DOCUMENTS

| | | | |
|---|---|---|---|
| CA | 2763511 | A1 | 1/2011 |
| CA | 2791489 | A1 | 12/2012 |
| EP | 2085572 | A2 | 8/2009 |
| GB | 1458906 | A | 12/1976 |

OTHER PUBLICATIONS

Lufkin, Plunger lift; Bumper Springs website, 2 pages, © 2013 Lufkin Industries, LLC www.lufkin.com.

Weatherford, Plunger Lift Systems brochure, 4 pages; © 2005 Weatherford www.weatherford.com.

Smalley Steel Ring Company; Constant Section Rings (Snap Rings); product brochure (website); 3 pages www.smalley.com/reatining/rings/constant-section-rings.

HPAlloys Website printout or Monel K500 (2004).

Lufkin, Lufkin Well Manager Controller For Rod Lift Systems; website, https://www.bhge.com/upstream/production-optimization/artificial-lift/artificial-lift-power-controls-and-automation.

* cited by examiner

APPARATUSES AND METHODS FOR SCRAPING

CROSS REFERENCE TO RELATED APPLICATIONS

The present application claims the benefit of U.S. Provisional Application No. 62/773,749, filed Nov. 30, 2018, and U.S. Provisional Application No. 62/876,155, filed Jul. 19, 2019, the entire contents of each of which are incorporated herein by reference.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein. Like numbers refer to like elements, but are not necessarily the same or identical elements throughout.

DETAILED DESCRIPTION

Figure 1A:
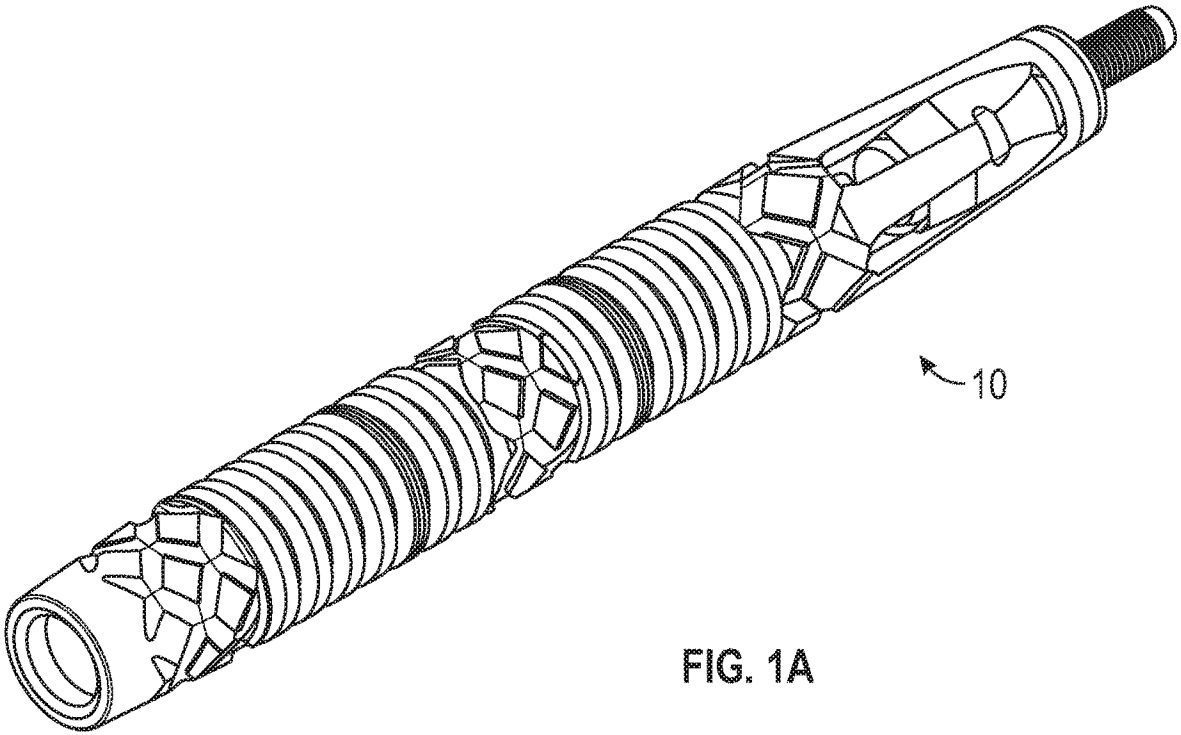
FIGS. 1A and 1B illustrate an apparatus including scraping features in accordance with one or more embodiments of the disclosure.

This disclosure generally relates to scraping features located on an outer surface of an apparatus, for example, a plunger, that travels through oil and/or gas well tubing and is configured to scrape an inner surface of the tubing.

For wells that have excess liquids or insufficient pressure, it is often desirable to use a plunger assembly that descends and ascends within well tubing or piping to restore production. For example, pressure in oil or gas wells may naturally deplete over time, causing liquids to accumulate in the downhole tubing. This liquid accumulation creates a hydrostatic head that may exceed the well's natural pressure and cause production to decrease or cease altogether. A plunger lift system may be used to remove liquids and permit the well to continue production even after well pressure has diminished.

In a plunger lift system, a plunger travels down the well tubing where it contacts a bumper spring located in the downhole tubing. When the plunger contacts the bumper spring, a bypass valve within the plunger is closed and a seal is created between the plunger and the tubing. The plunger lift system is designed to have minimal clearance between the tubing and the plunger as it travels down the tubing such that the stop or plug can act as an effective seal to increase the backpressure within the well tubing.

When the downhole pressure reaches a preset or predetermined amount, a downstream surface valve is opened, pressure in the tubing above the plunger decreases, and the plunger ascends to the surface. The plunger is captured in a receiver that reopens the bypass valve, and well fluids flow through the tubing until the well pressure again decreases. The surface valve is then closed and the cycle repeats as the plunger is released and descends through the well tubing.

In wells with decreases in pressure and temperature, heavier components, such as paraffin, have a tendency to precipitate and accumulate on tubing surfaces. For example, paraffin may crystalize and deposit on inner walls of the well tubing when well fluids experience, for example, drops in temperature due to heat loss along a subsea pipeline and/or cooling due to gas expansion, as is common in wells with decreased pressure. Accumulation of solids on walls of the tubing may further decrease well production by choking flow through the tubing.

When using a plunger lift system to restore production, minimal clearances between the plunger and the tubing are essential to create the necessary seal for increasing pressure in the well. Due to the minimal clearance area between the tubing and the plunger, buildup of materials on the inner wall of the tubing may impede or prevent movement of the plunger within the well tubing. By applying a scraping feature to an outer surface of the plunger, the plunger may scrape the inner surface of the tubing walls, preventing and removing deposits of materials, such as paraffins, asphaltenes, salt, hydrates, debris, solids, etc. The removed deposits may then be carried up the tubing. The plunger may thus freely travel through the tubing and create a proper seal.

If deposited materials are not removed regularly, well production may be further reduced or completely inhibited. Conventionally, buildup on well tubing has been removed via slickline units, hot oiling, hot water, thermal treatment, chemical treatment, or a combination thereof. These treatments are expensive and typically involve shut-in of the well while the tubing is cleaned, which disrupts production and further increases the effective cost of removal. By using a plunger lift assembly that includes features designed to scrape and remove buildup on an inner surface of piping or tubing, in accordance with disclosed embodiments, well production may be restored and buildup removed and/or prevented in an affordable manner.

Although this disclosure describes scraping features that may be used on various types of oil and/or gas well plungers, e.g., conventional, barstock/fast fall, sliding sleeve, bypass, etc., the present disclosure is not intended to be limited to such disclosed apparatuses or environments. For example, the scraping features disclosed herein may be implemented on other equipment, e.g., pigs, and in any environment that may have material deposited on an inner surface thereon, e.g., production equipment.

Figure 1B:
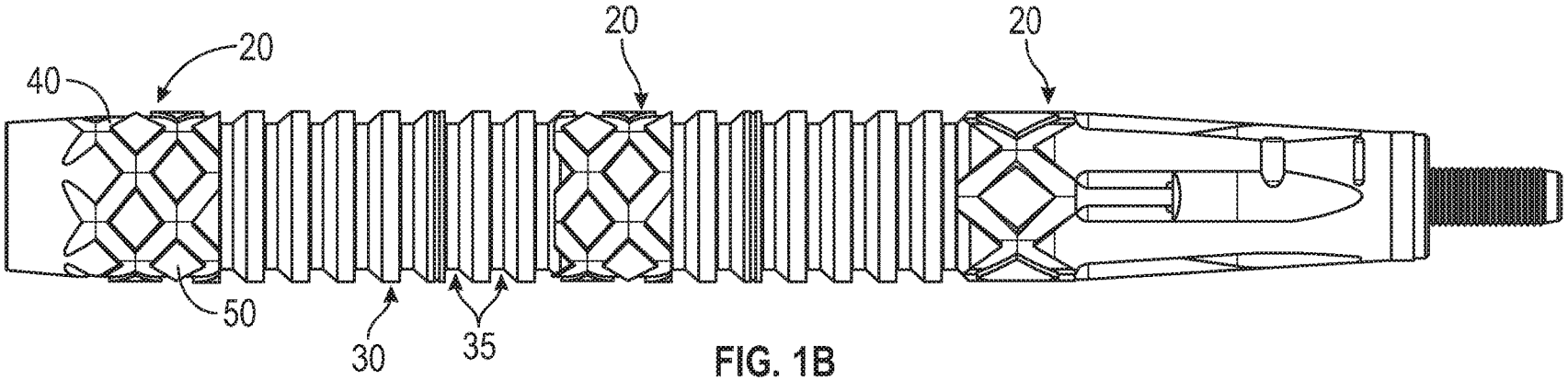

FIGS. 1A and 1B illustrate an example embodiment of the present disclosure that may be used in combination with a device, for example, plunger 10, in accordance with embodiments of the disclosure. A scraping feature 20 may facilitate removal of buildup on an inner surface of oil or gas well tubing. One or more scraping features 20 may be located at one or more locations along a length of the plunger 10, or along substantially an entire length of the plunger 10, and may be arranged either partially or completely around a circumference of the plunger 10, or may be used with another cleaning tool.

Figure 2A:
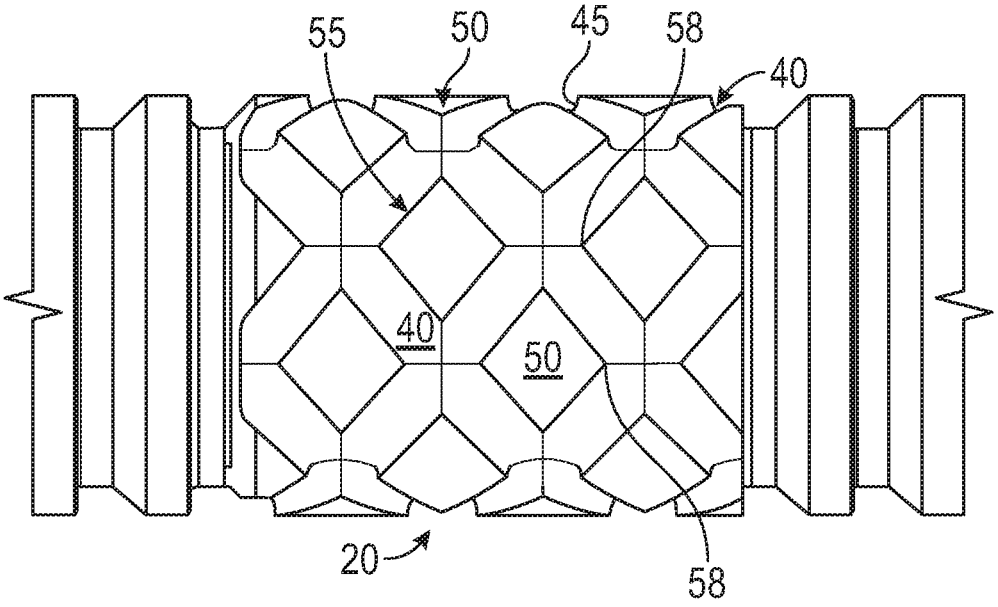
FIGS. 2A to 2G are enlarged side views of a scraping feature in accordance with one or more embodiments of the disclosure.

Conventional plungers typically include seals 30 with recesses 35 on either side of the seal 30. However, in wells that have material built up on the inner surface of the tubing, the built up material (e.g., paraffins) may become trapped in recesses 35, clogging the recesses 35 and thereby inhibiting operation of a conventional plunger. However, as shown in FIG. 2A, the scraping feature 20 of the present disclosure includes at least one groove 40 and at least one ridge or raised surface 50 that may facilitate scraping of sidewalls of well tubing, while preventing excess deposit or accumulation of displaced material within the grooves 40 or recesses 35 of the plunger 10. As shown in FIG. 1B, multiple ridges 50 and/or grooves 40 may be used in combination. Widths and/or lengths of the ridges 50 and/or grooves 40 may be varied as needed for the intended application.

FIGS. 2A to 2G illustrate enlarged side views of a scraping feature 20 in accordance with one or more embodiments of the disclosure. Ridge 50 and groove 40 may include "U" (FIG. 2E), "V" (FIG. 2F), "W" (FIG. 2G), circular, oval, or diamond shapes, or combinations thereof. Additionally, edges of the ridge 50 may include straight or curved portions, and/or a combination thereof. For example, as shown in FIGS. 2A to 2G, edges of the ridge 50 (e.g., shapes of the edges around the perimeter of the ridge 50) may include a straight edge 55 (e.g., FIG. 2A), or may include a concave curved edge 56 (e.g., FIG. 2B), or may include a convex curved edge 57 (e.g., FIG. 2C). Edges of the ridge 50 could also include portions that are both convex and concave (e.g., a wave form, not shown), or a combination of straight and curved portions (not shown).

Figure 2B:
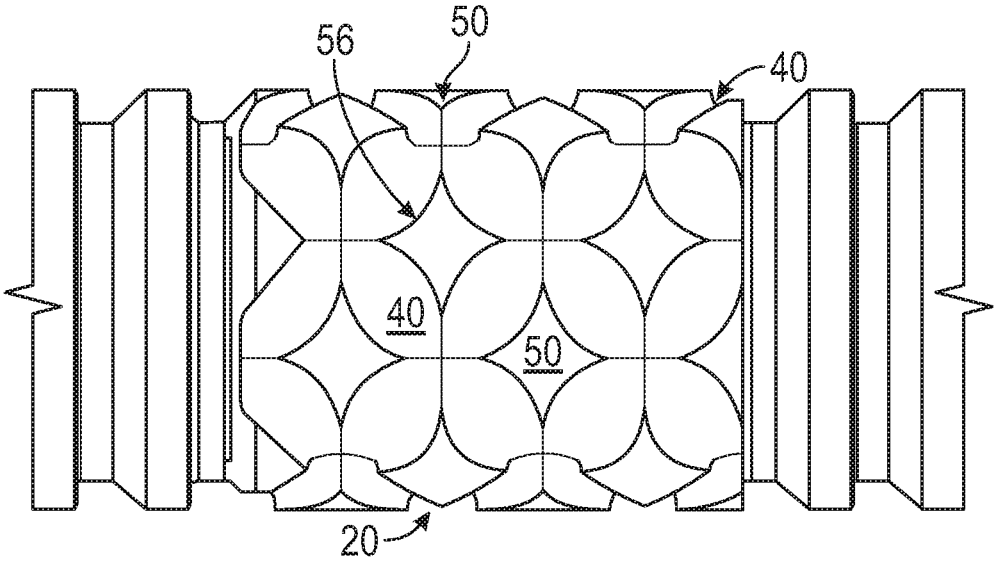
Figure 2C:
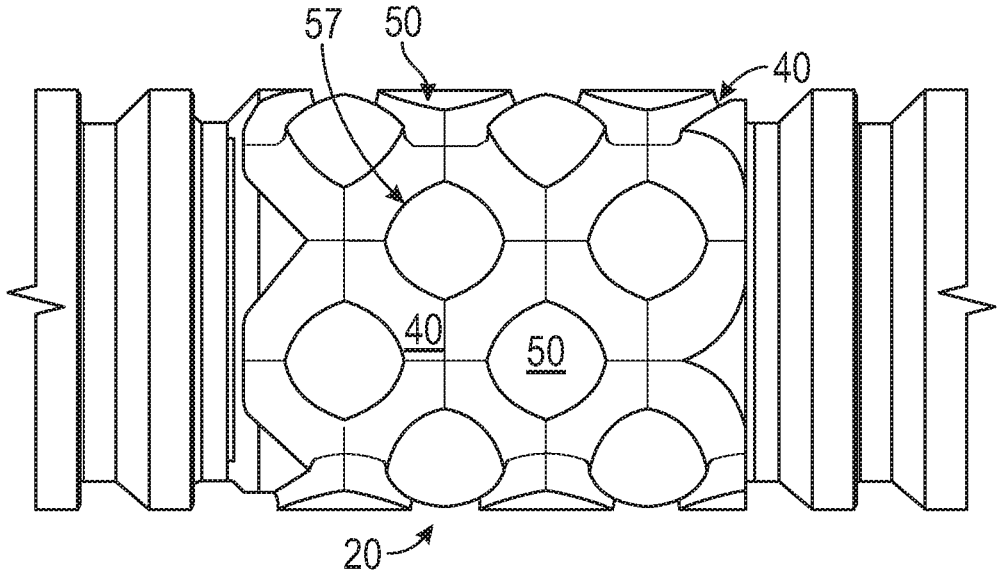
Figure 2D:
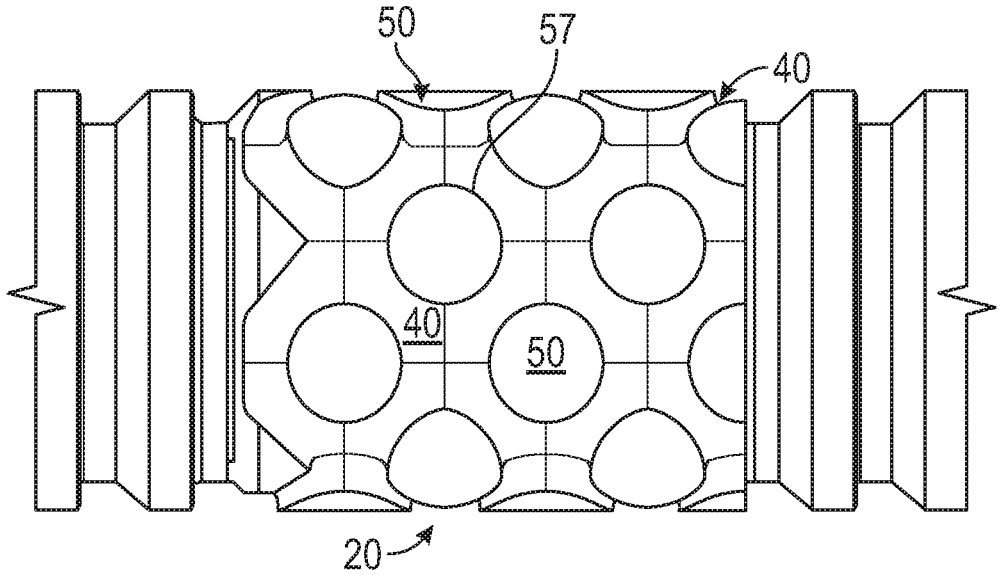
Figure 2E:
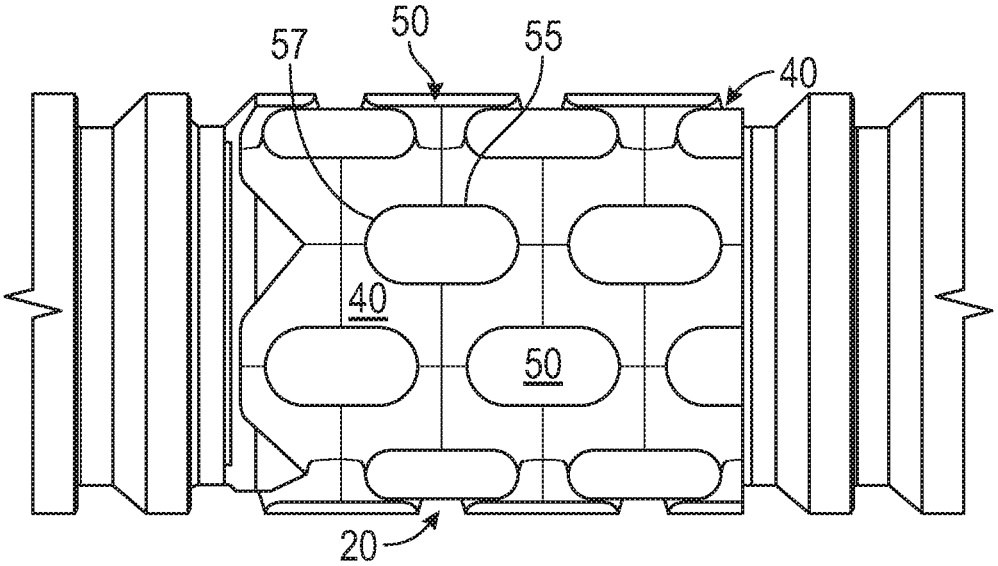
Figure 2F:
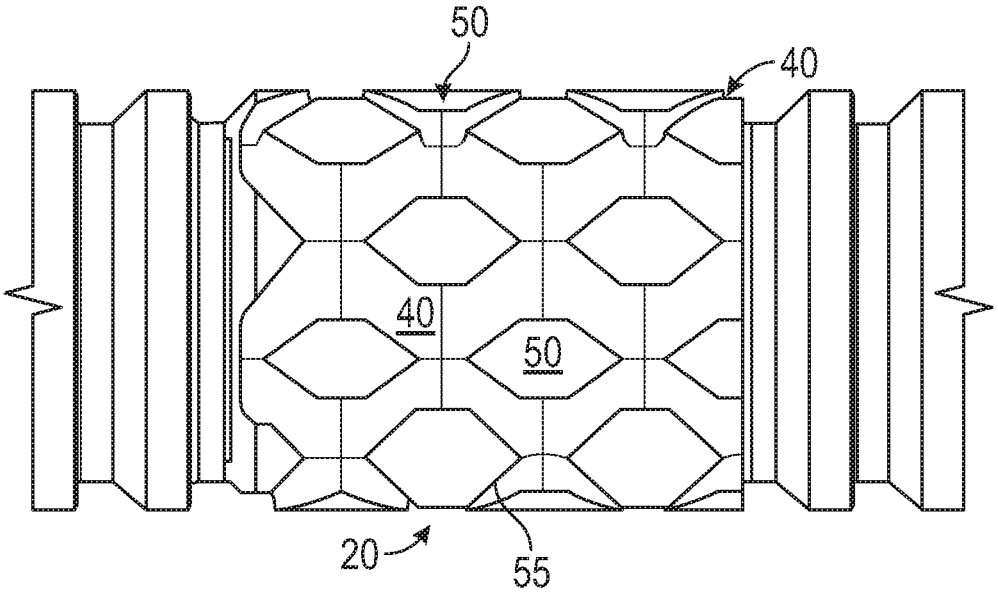
Figure 2G:
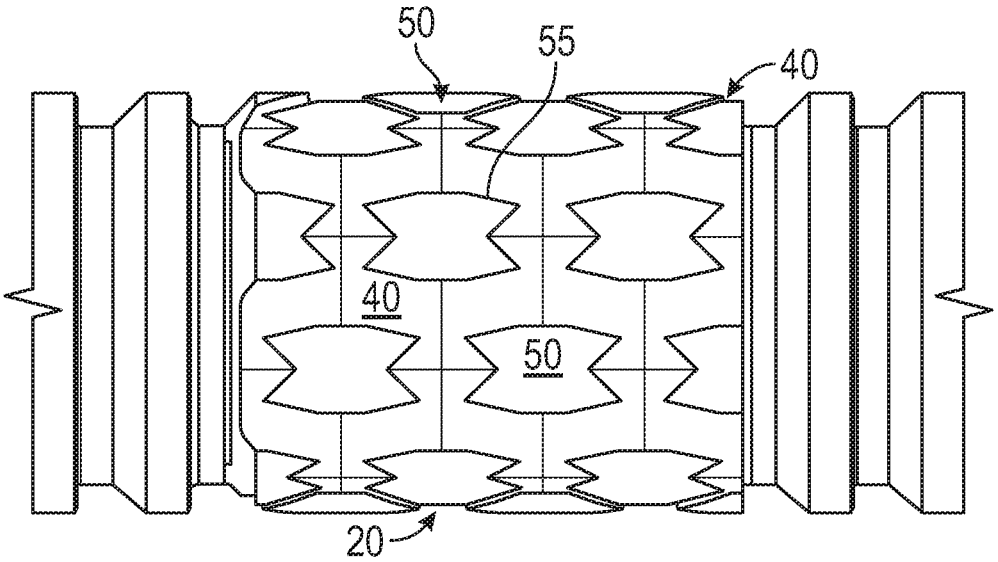

For example, as shown in FIGS. 2A, 2F, and 2G, edges of the ridge 50 may include a combination of straight edges 55. As shown in FIG. 2B, edges of ridge 50 may include concave curved edges 56 or, as shown in FIGS. 2C and 2D, may include convex curved edges 57. Alternatively, edges of ridge 50 may include a combination of convex edges 57 and straight edges 55, as shown in FIG. 2E. However, these shapes are not intended to be exhaustive or limiting, and any shape that permits scraping of sidewalls of the tubing and displacement of the scraped buildup material, preferably away from the plunger body, is considered to be within the scope of the present disclosure.

The ridges 50 may also be altered as needed. For example, angles between two surfaces of the ridges 50, e.g., an angle $\alpha$ between sides of the "V" (as shown in FIG. 3C) may be altered. The angle $\alpha$ may be varied depending on the intended application and may be an acute angle, an obtuse angle, or a 90 degree angle, and may include a fillet. In addition, the ridge 50 may be formed integrally with the plunger 10 or, alternatively, may be a separate element that has been integrated into the plunger 10, or may be a separate element that may be removable from the plunger.

In an embodiment with diamond-shaped ridges 50, as shown in FIG. 2A, a leading edge 58 and/or a trailing edge of the ridge 50 may be oriented such that a narrowest portion of the ridge 50 is substantially pointed and located on a forwardmost and/or rearmost side of the plunger 10, depending on a direction of intended travel. The arrangement shown in FIG. 2A, for example, may facilitate removal of solids from the tubing during both forward and backward travel of the plunger 10 because the narrowest portion of the ridge 50 is pointed, forming a leading edge 58 during both forward and backward travel of the plunger 10 through the tubing.

Figure 5A:
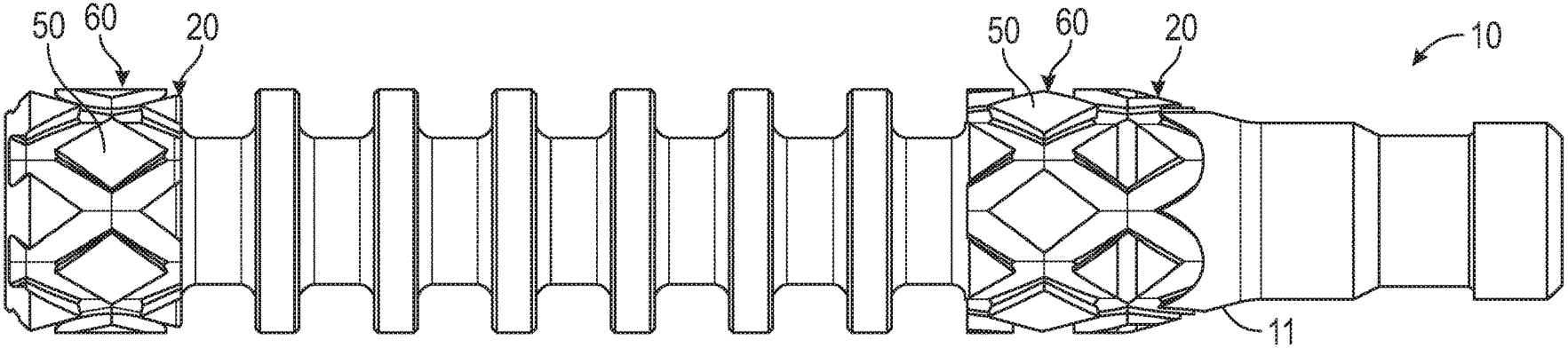
FIGS. 5A to 5D illustrate an apparatus including scraping features in accordance with one or more embodiments of the disclosure.
Figure 5B:
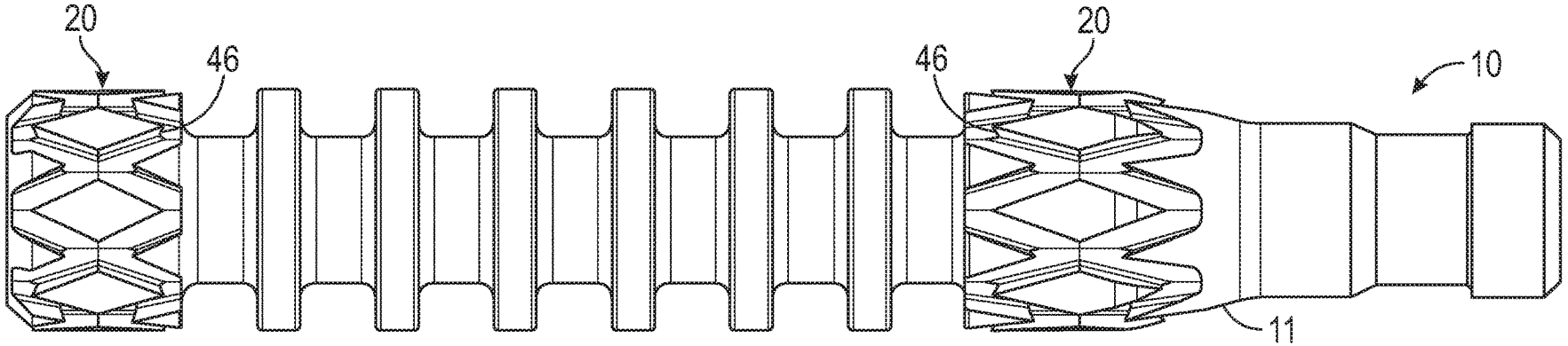
Figure 5C:
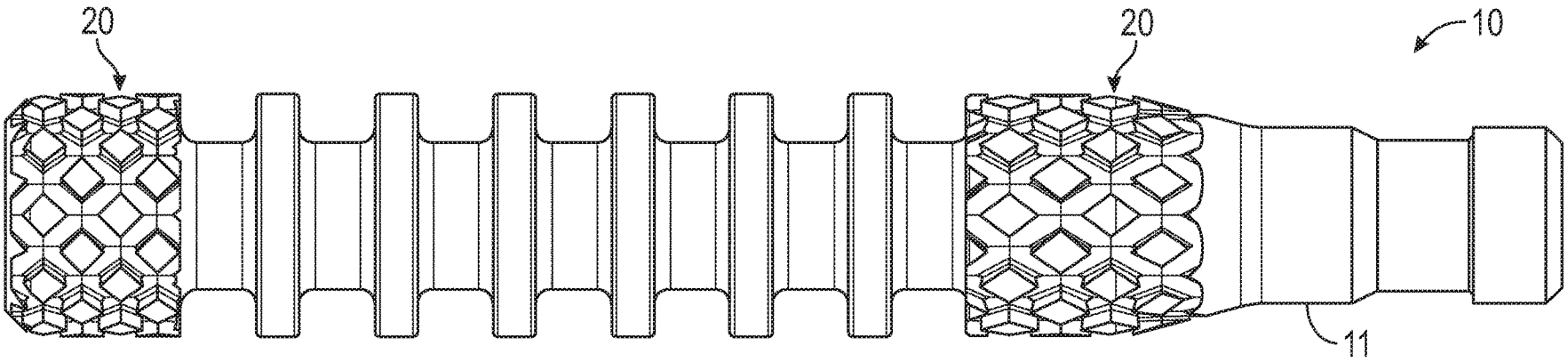
Figure 5D:
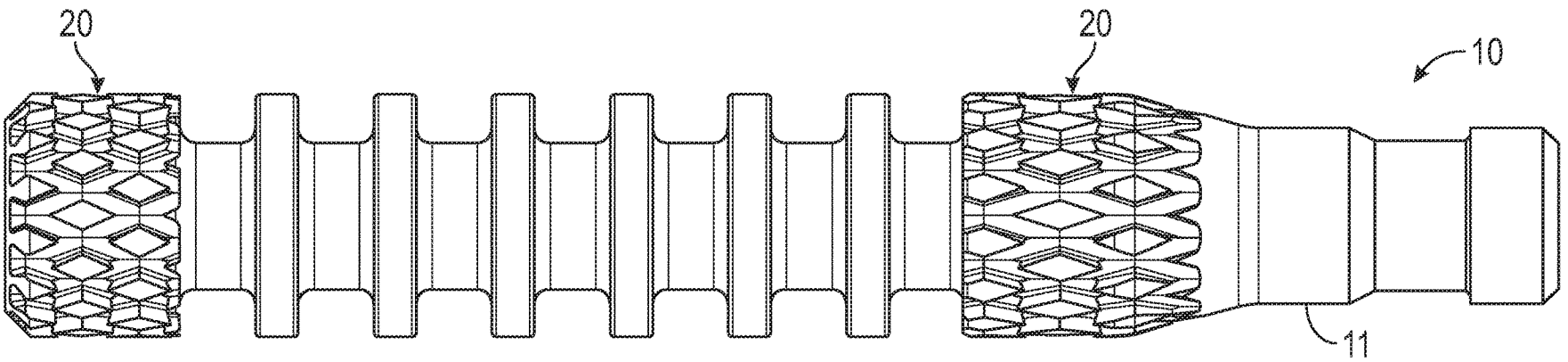

In one example, the grooves 40 (e.g., as shown in FIG. 2A) may be located on a circumferential side of the ridges 50 and/or between the ridges 50 to facilitate displacement of the scraped buildup material around the ridge 50. The grooves 40 may also include sloped or tapered surfaces 45 (FIG. 2A) that further facilitate movement and removal of the scraped buildup material out of the groove 40 as additional scraped buildup material enters the groove 40. The tapered surfaces 45 may be of the edge of grooves 40 and/or may be located between the ridges 50 such that sides of the ridge 50 are sloped (e.g., FIG. 3A). Tapered surfaces 45 may be arranged at an obtuse angle with respect to a bottom surface of the groove 40, as shown in FIG. 3C; at an acute angle with respect to a bottom surface of the groove 40 (e.g., such that an undercut portion 46 is formed); or may include a combination of tapered surfaces 45 that are obtuse and acute with respect to a bottom surface of the groove 40 (e.g., FIG. 5B). In addition, the tapered surface 45 may extend to an outer surface 60 (FIG. 3A), or may stop below the outer surface 60 (FIG. 3B).

Figure 3A:
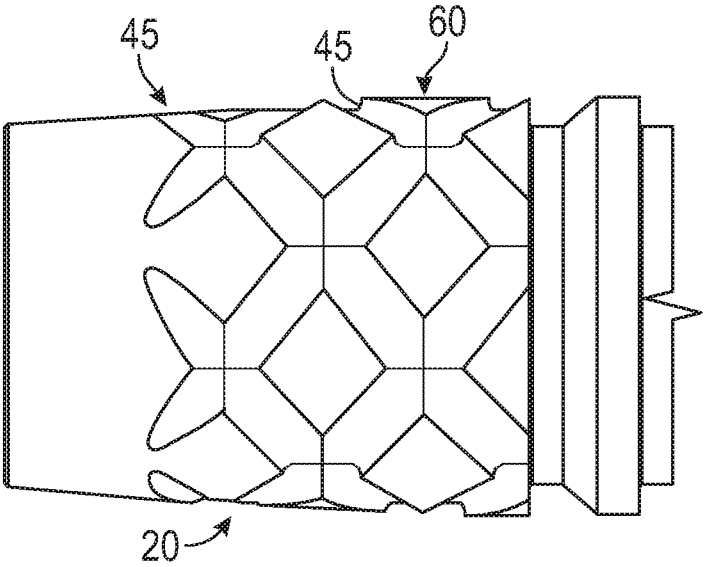
FIGS. 3A to 3C are enlarged views of a scraping feature in accordance with one or more embodiments of the disclosure.
Figure 3B:
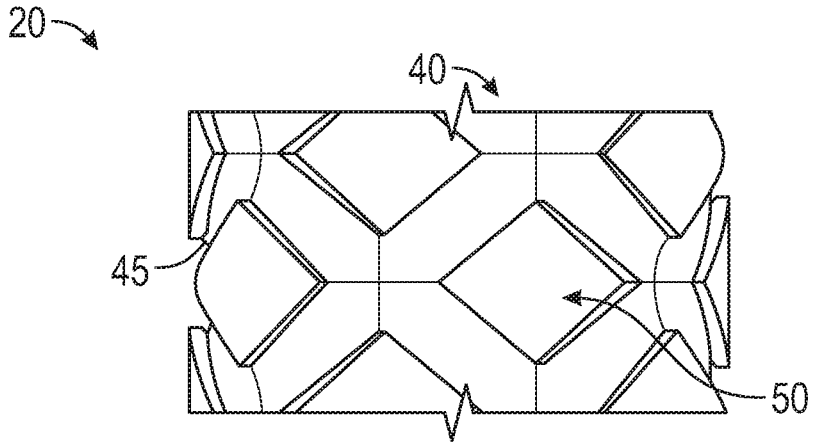
Figure 3C:
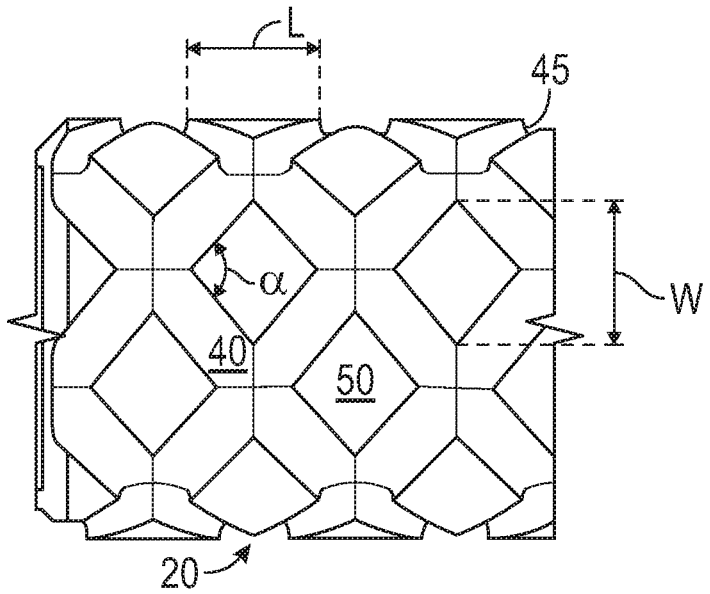

As shown in FIG. 3A, the outer surface 60 of the ridge 50 may extend to a height that is substantially the same as an outer diameter of the plunger 10. In other embodiments, the outer surface 60 of the ridge 50 may extend to a height that is greater than the outer diameter of the plunger 10. Alternatively, the outer surface 60 of the ridge 50 may have a height that is less than the outer diameter of the plunger 10, or may have an outer surface 60 that varies along a length/width of the ridge 50 (e.g., FIG. 5A), such that portions of the height of the outer surface 60 could be a combination of lower than, greater than, and/or the same as an outer diameter of the plunger 10.

A depth of the grooves 40 may also be varied depending on the environment in which the scraping feature 20 is intended to be implemented. That is, the depth of grooves 40 may be chosen to ensure sufficient wall thickness for the intended application, e.g., high well pressures, corrosive environments, etc., while accounting for amounts of solid material that may be deposited on an inner surface of the tubing.

The depth of the grooves 40 may be chosen to ensure that a sufficient ratio of an outer diameter ("OD") of the plunger 10 to an inner diameter ("ID") of the plunger 10 is maintained according to the intended environment. For example, potentially corrosive environments will require a greater OD to ID ratio. However, a flow of fluids through the plunger 10 may be maximized by minimizing the OD to ID ratio, which may in turn permit the plunger 10 to travel through the well tubing more quickly and efficiently. In a non-limiting example, the ratio of the OD to ID may be in a range of approximately 1.2 to approximately 1.9.

In operation, material such as paraffin that has built up on an inner surface of tubing comes in contact with the ridge 50 and is scraped free of the inner surface of the tubing by ridge 50. Scraped material may be pushed by the ridge 50 into the grooves 40 and displaced through the grooves 40 until the scraped buildup material exits the grooves 40. Material may then be dispersed within the tubing and carried away by well fluids. In various embodiments, the scraping feature 20 may be designed to remove buildup in a forward/downward direction of the plunger 10, a backward/upward direction of the apparatus or plunger 10, or both. For example, as shown in FIG. 2A, scraping feature 20 may have ridges 50 with a diamond shape that is pointed in both a forward and rearward direction of the plunger 10, forming a leading edge 58 on each of opposite sides of the ridge 50. One leading edge 58 is thus able to scrape the inner surface of the tubing while traveling in either a forward or backward direction.

FIG. 3C shows an enlarged detail view of a scraping feature in accordance with one or more embodiments of the disclosure. The grooves 40 and ridges 50 may be sized according to the intended environment in which the plunger 10 is configured to be used. In a non-limiting example, the ridges 50 may be arranged in a pattern that includes five or six ridges 50 that are arranged around a circumference of the plunger 10 by one to three ridges 50 that extend along a longitudinal length of the plunger 10. For example, the ridge 50 may extend along a length of the plunger 10 for approximately 1.75 inches to approximately 2.25 inches, and each ridge 50 may include a length L that is in a range of approximately 0.7 inches to approximately 1.75 inches, and a width W that is in a range of approximately 0.25 inches to approximately 0.35 inches.

Figure 4A:
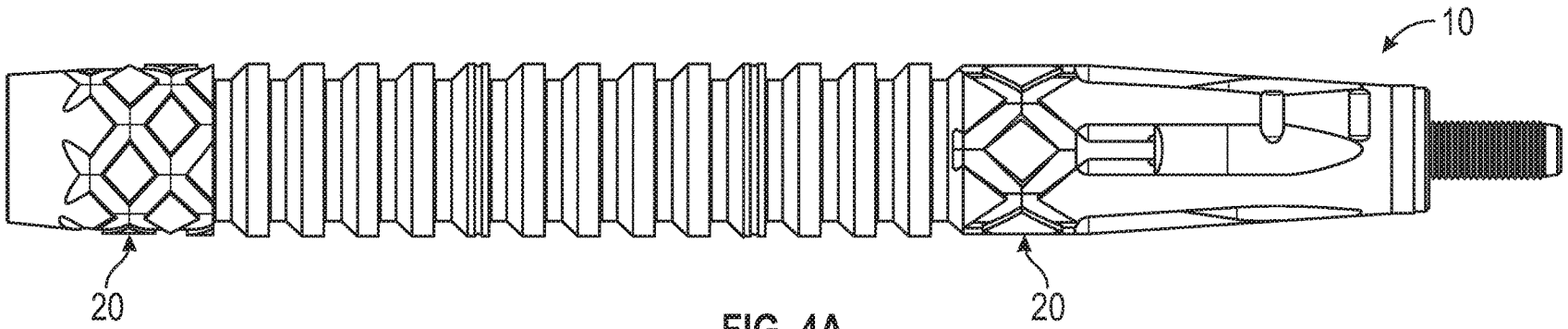
FIGS. 4A to 4J illustrate the apparatus of FIGS. 1A and 1B including one or more alternative scraping features in accordance with one or more embodiments of the disclosure.
Figure 4B:
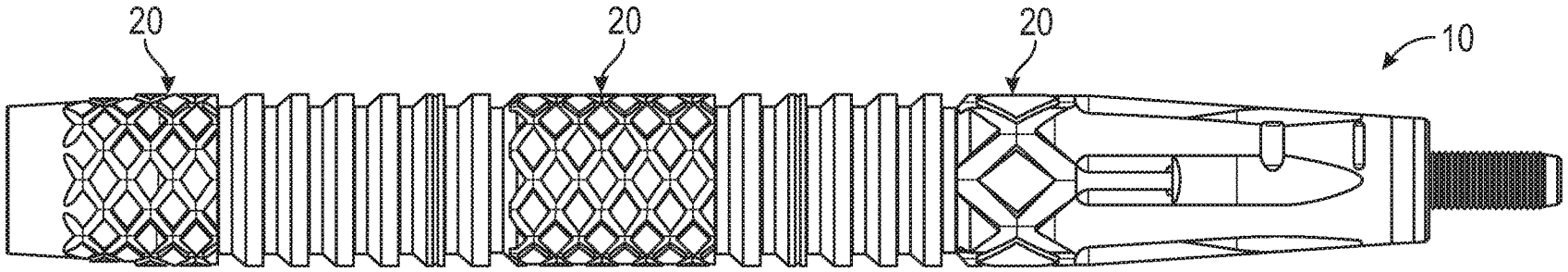
Figure 4C:
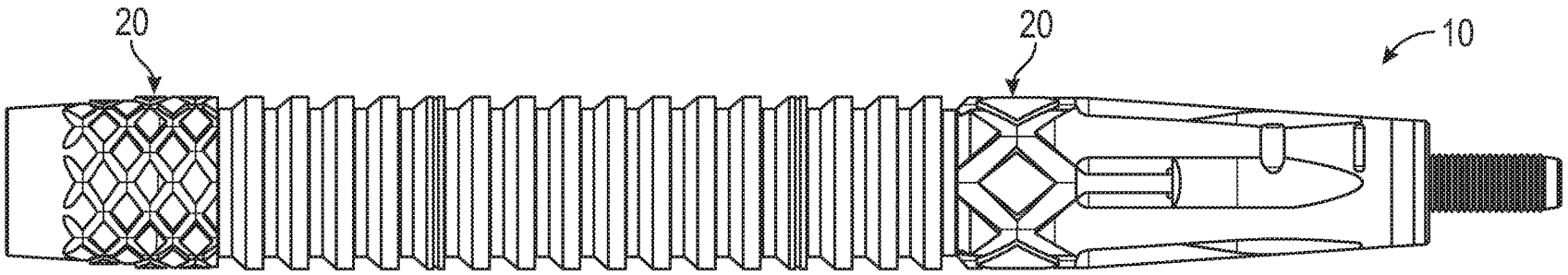
Figure 4D:
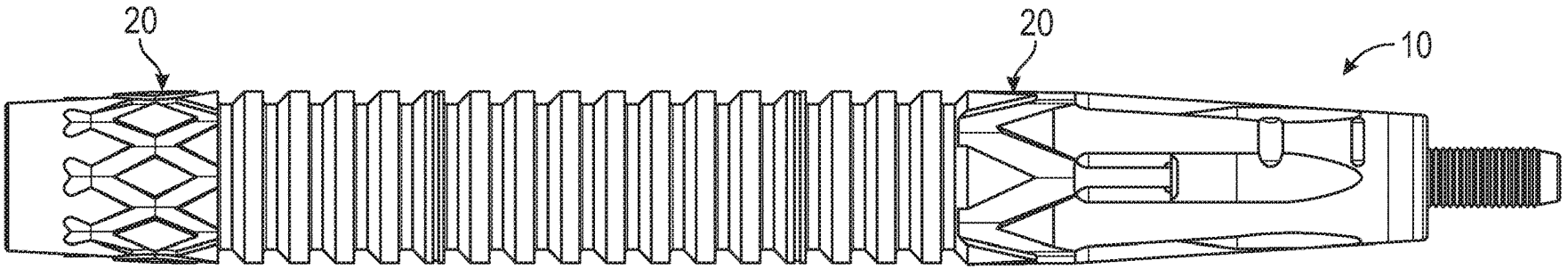
Figure 4E:
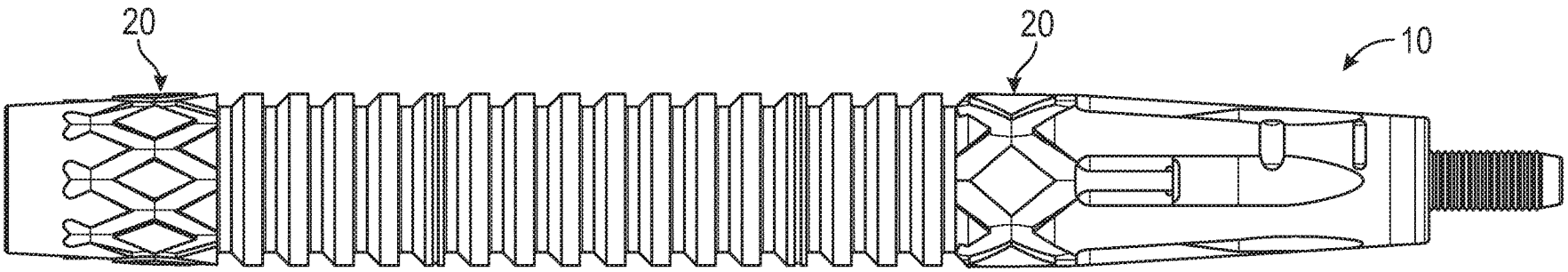
Figure 4F:
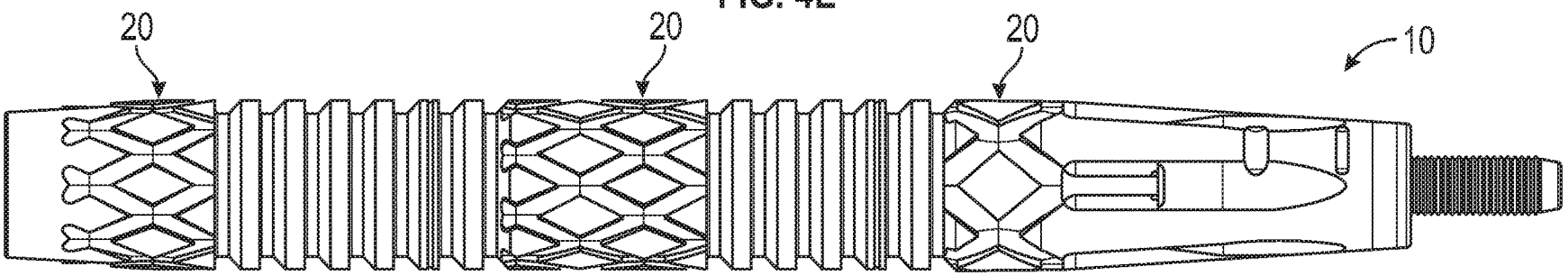
Figure 4G:
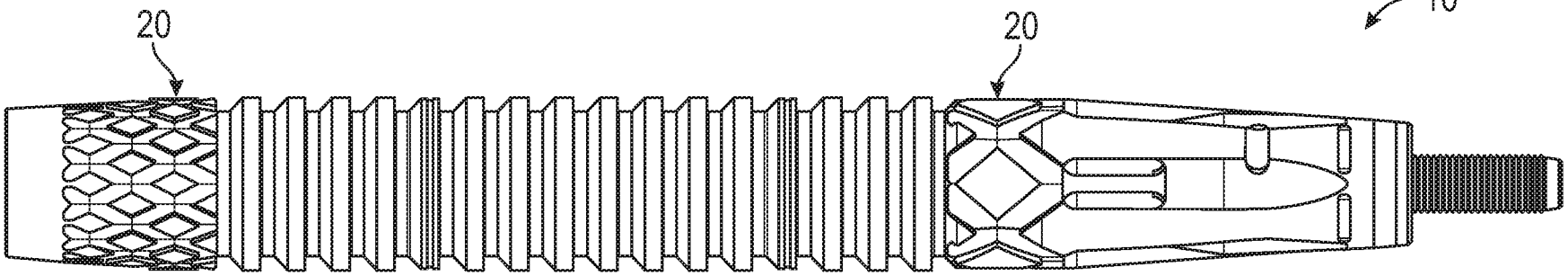
Figure 4H:
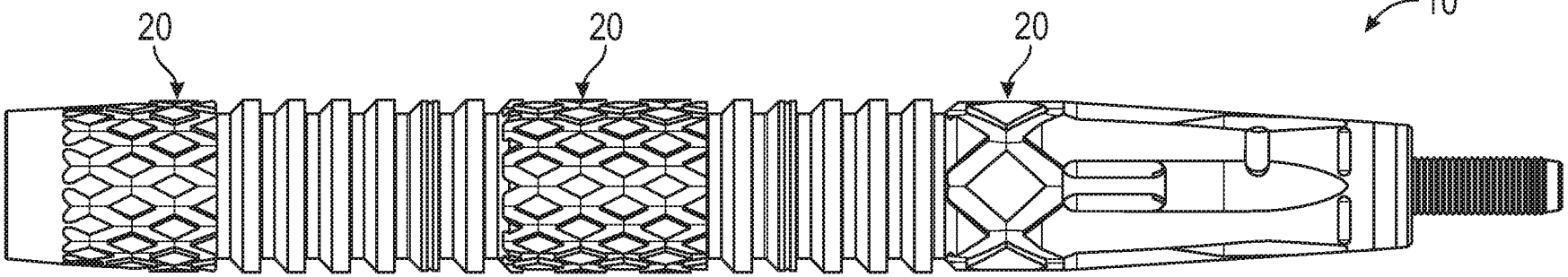
Figure 4I:
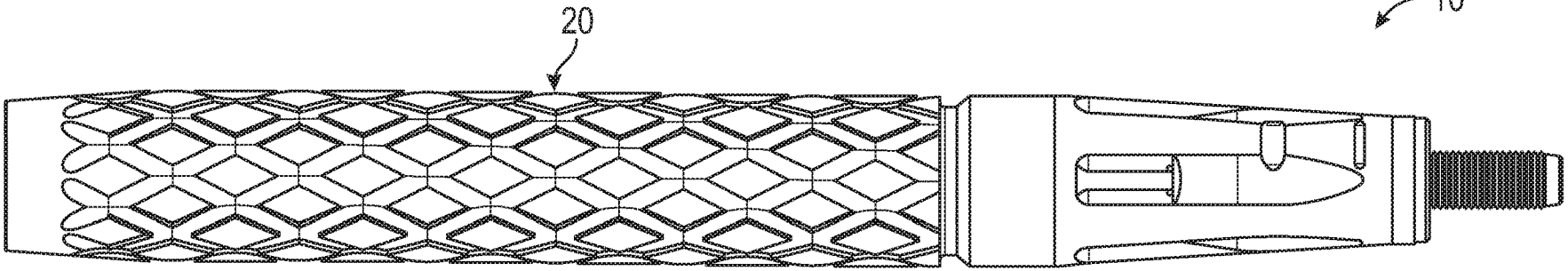
Figure 4J:
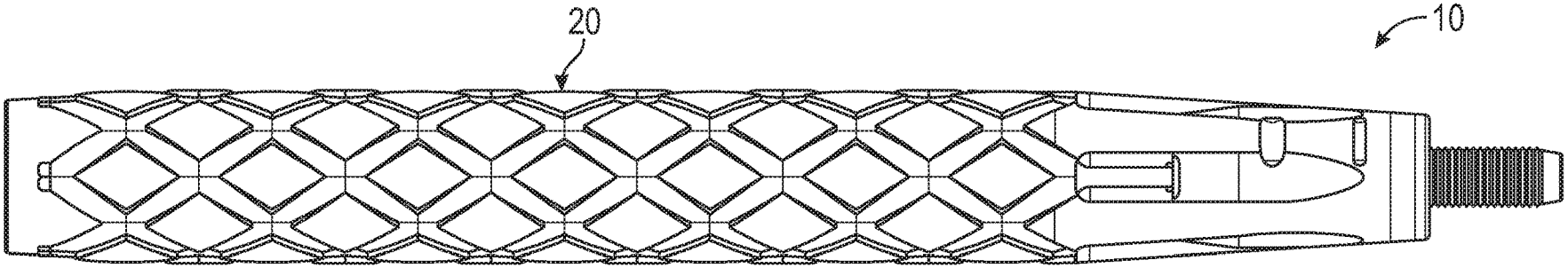

FIGS. 4A to 4J illustrate the plunger apparatus of FIGS. 1A and 1B with one or more alternative embodiments of the scraping features in accordance with one or more embodiments of the disclosure. As shown in FIGS. 1A, 1B, and 4A to 4H, the plunger 10 may include, for example, two or more areas which include a scraping feature 20. FIGS. 41 and 4J illustrate embodiments that may include one scraping feature 20 along substantially an entire length of the body of plunger 10. However, as noted above, the present disclosure is not limited to the number of scraping features 20 that may be included on an apparatus, and use of one or more scraping features 20 on an apparatus are within the scope of the present disclosure. In addition, a width and/or length of each of the ridges 50 and grooves 40 (e.g., as shown in FIG. 3C) and/or the scraping feature 20 may vary according to the intended application.

FIGS. 5A to 14B illustrate additional apparatuses that include one or more scraping features in accordance with one or more embodiments of the disclosure. As shown in FIGS. 5A to 14B, the scraping feature 20 may be used on conventional, bypass, barstock/fast fall, sliding sleeve, or pad type plunger, or any other plunger for use in a plunger lift system.

FIGS. 5A to 5D illustrate plungers 10 that include the scraping feature 20 in accordance with one or more embodiments of the disclosure. As shown in FIGS. 5A to 5D, the plunger 10 may include, for example, two or more areas which include scraping feature 20.

Figure 6A:
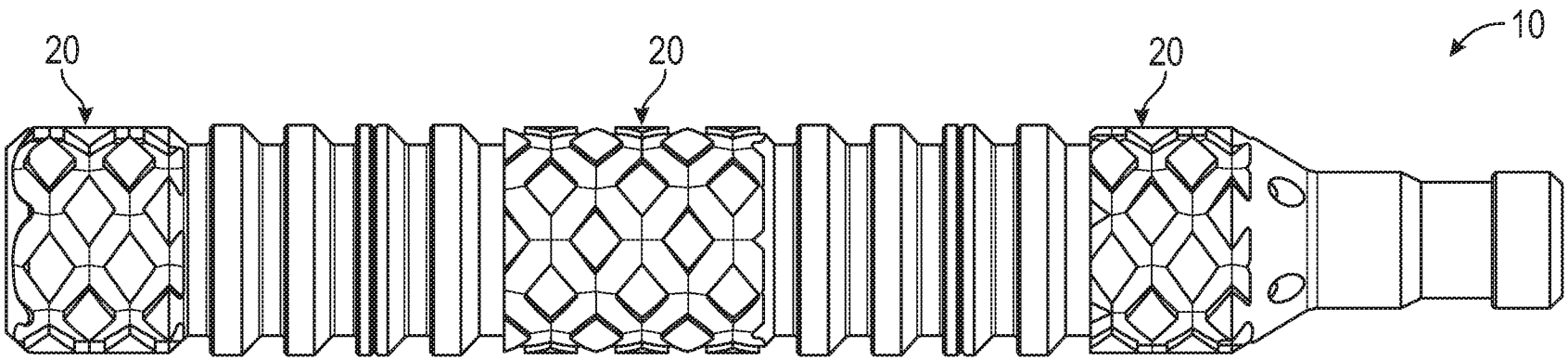
FIGS. 6A to 6F illustrate an apparatus including scraping features in accordance with one or more embodiments of the disclosure.
Figure 6B:
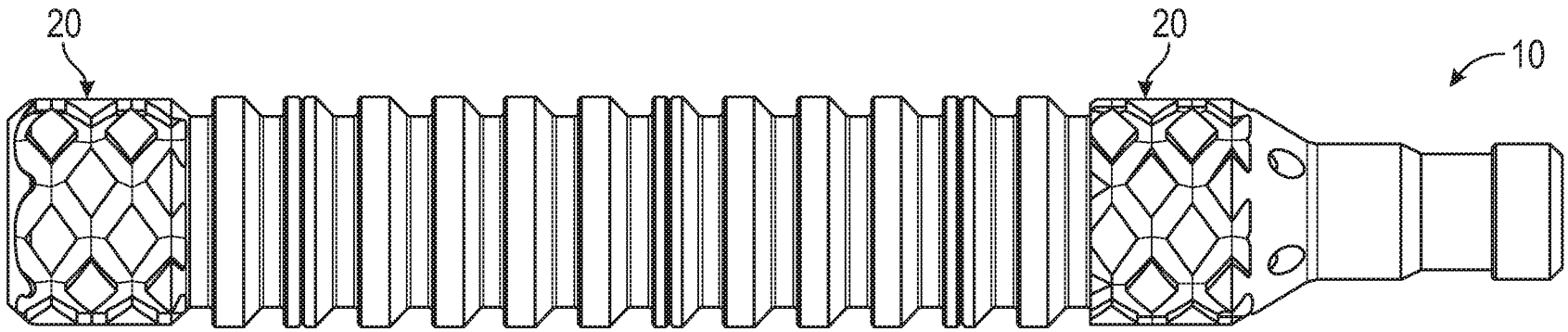
Figure 6C:
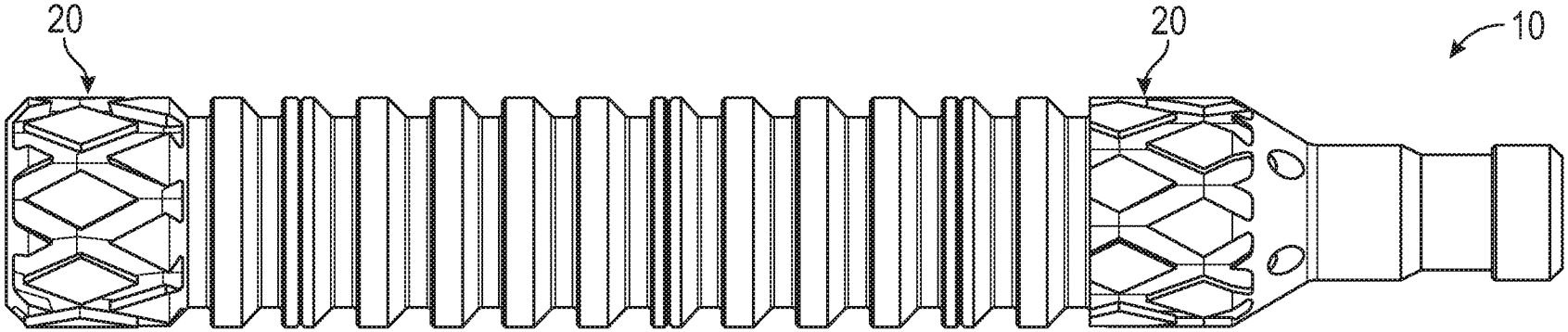
Figure 6D:
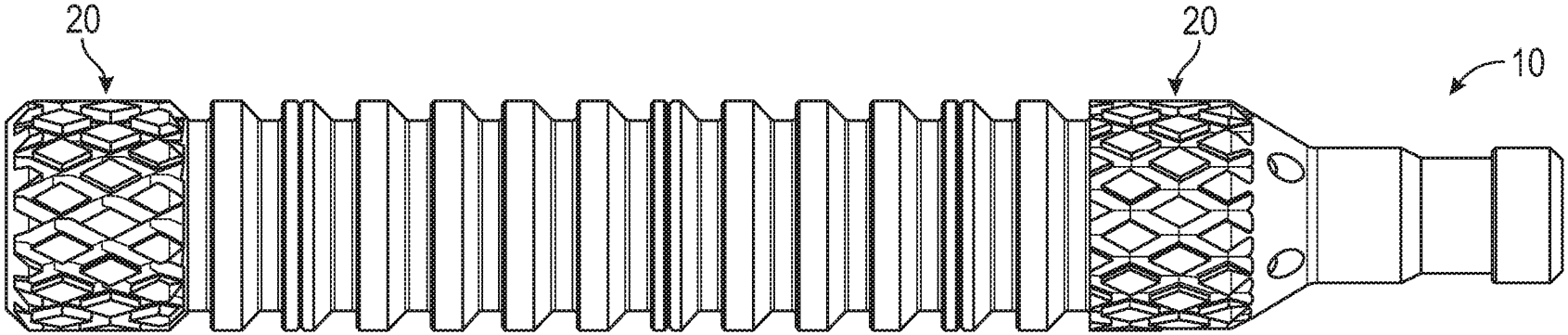
Figure 6E:
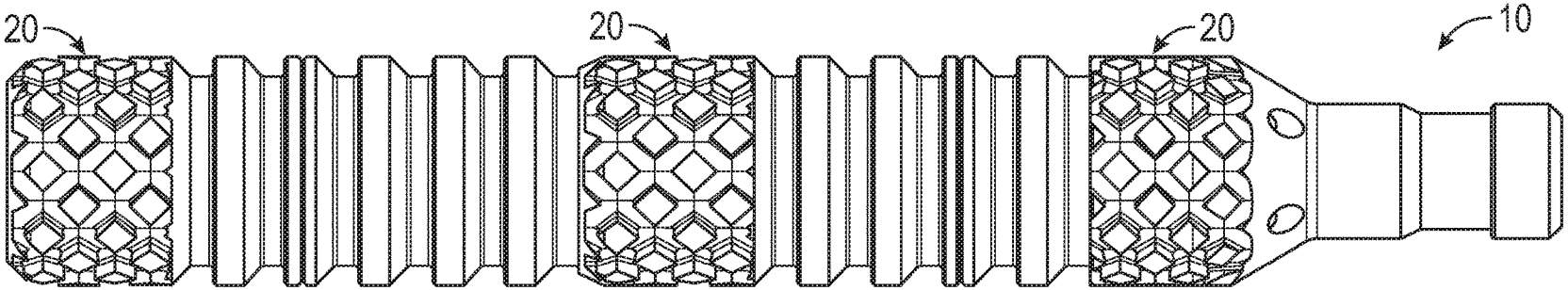
Figure 6F:
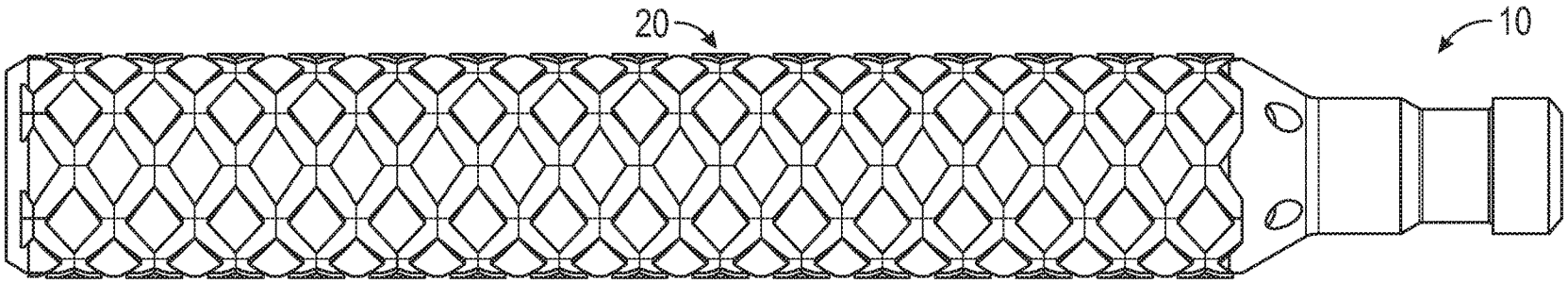
Figure 7:
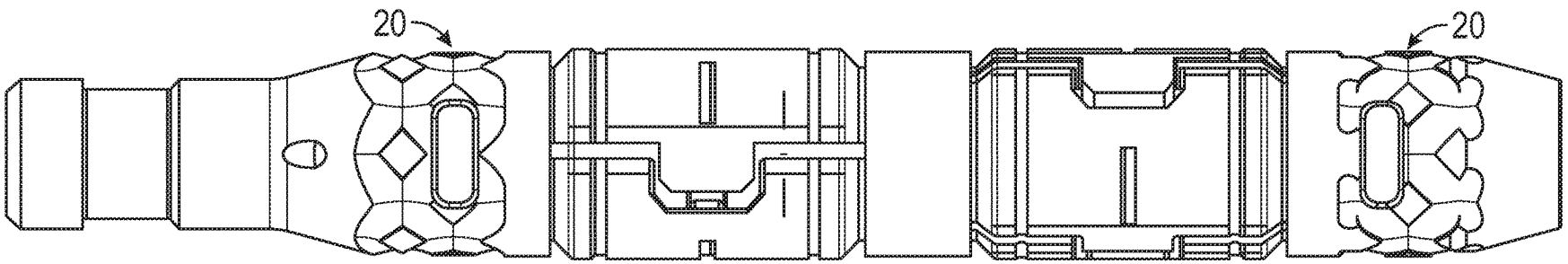
FIG. 7 illustrates an apparatus that includes scraping features in accordance with one or more embodiments of the disclosure.

FIGS. 6A to 6F illustrate plungers 10 that include one or more scraping features 20 in accordance with one or more embodiments of the disclosure. As shown in FIGS. 6A and 6E, the plunger 10 may include three or more areas which each include scraping feature 20. Alternatively, the plunger may include two that include scraping feature 20, as shown in FIGS. 6B to 6D. In another embodiment, the plunger may include a scraping feature 20 along substantially an entire length of the plunger 10, as shown in FIG. 6F.

Figure 8:
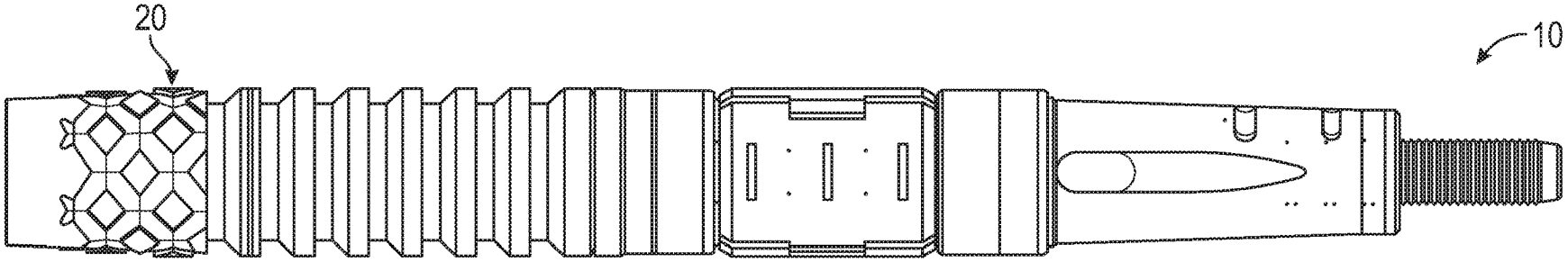
FIG. 8 illustrates an apparatus that includes a scraping feature in accordance with one or more embodiments of the disclosure.
Figure 9:
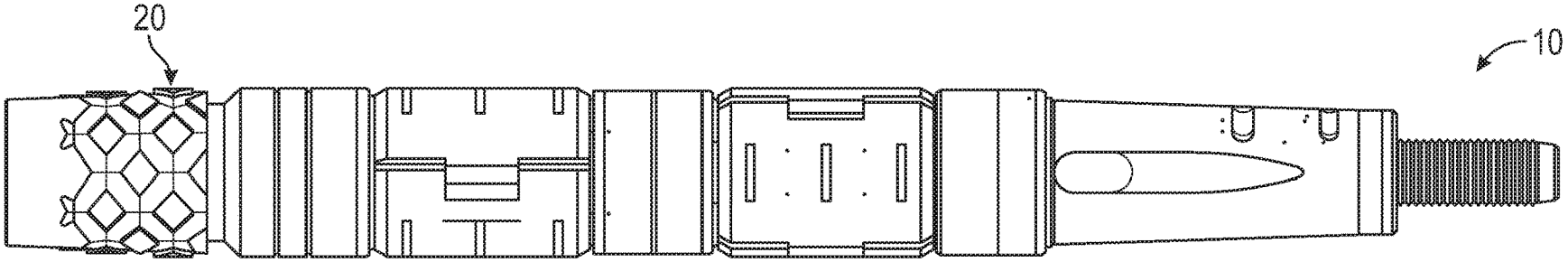
FIG. 9 illustrates an apparatus that includes a scraping feature in accordance with one or more embodiments of the disclosure.
Figure 10:
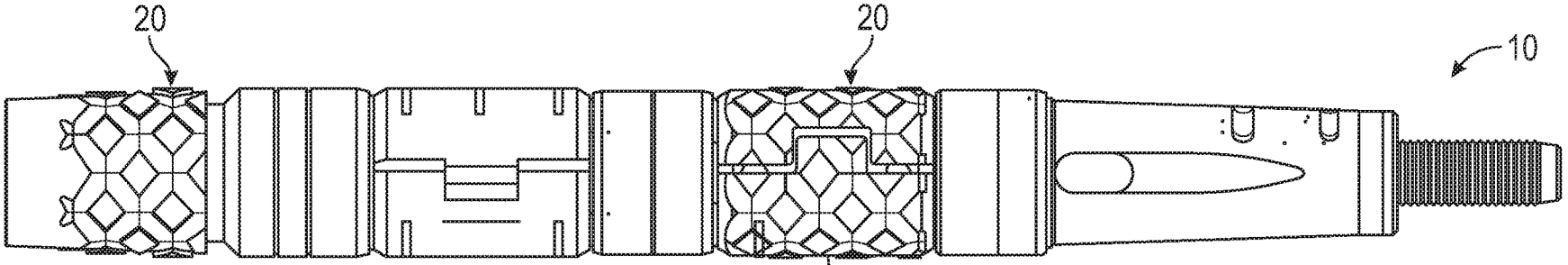
FIG. 10 illustrates an apparatus that includes scraping features in accordance with one or more embodiments of the disclosure.
Figure 11:
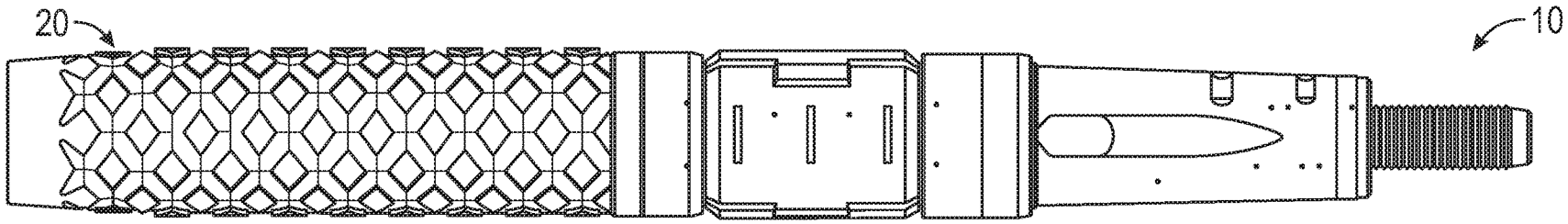
FIG. 11 illustrates an apparatus that includes a scraping feature in accordance with one or more embodiments of the disclosure.
Figure 12:
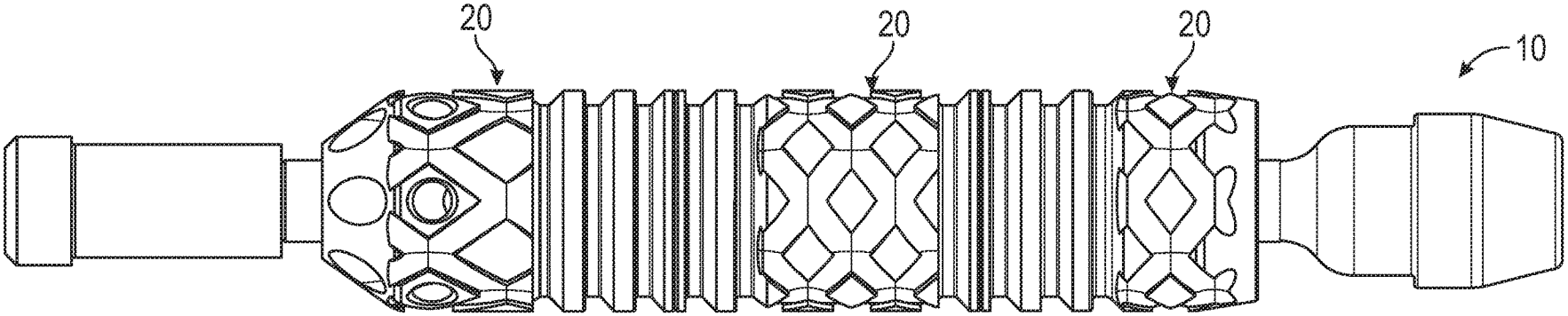
FIG. 12 illustrates an apparatus that includes scraping features in accordance with one or more embodiments of the disclosure.
Figure 13:
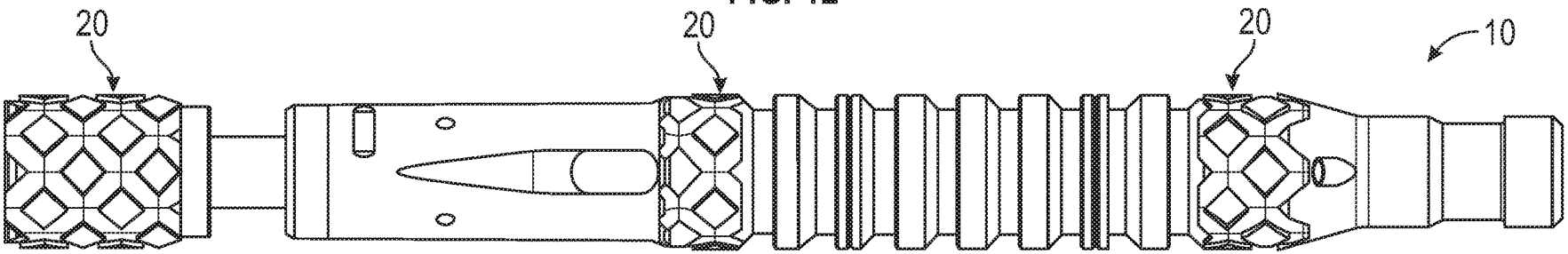
FIG. 13 illustrates an apparatus that includes scraping features in accordance with one or more embodiments of the disclosure.
Figure 14A:
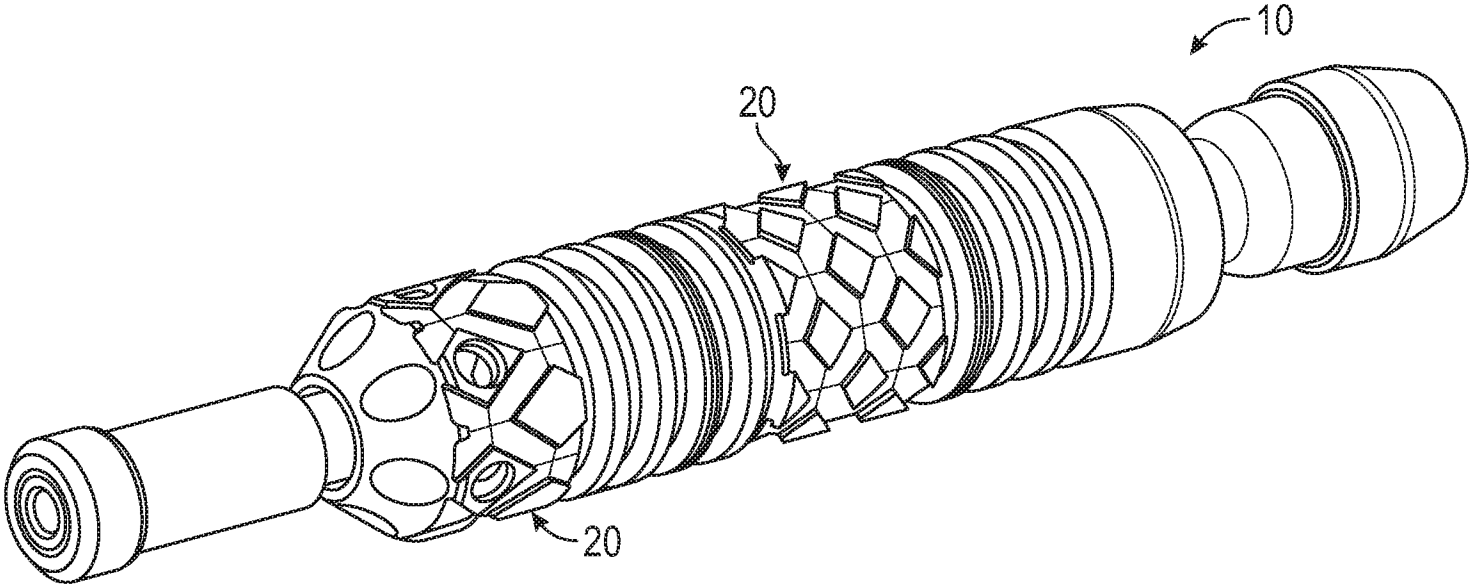
FIGS. 14A and 14B illustrate an apparatus that includes scraping features in accordance with one or more embodiments of the disclosure.
Figure 14B:
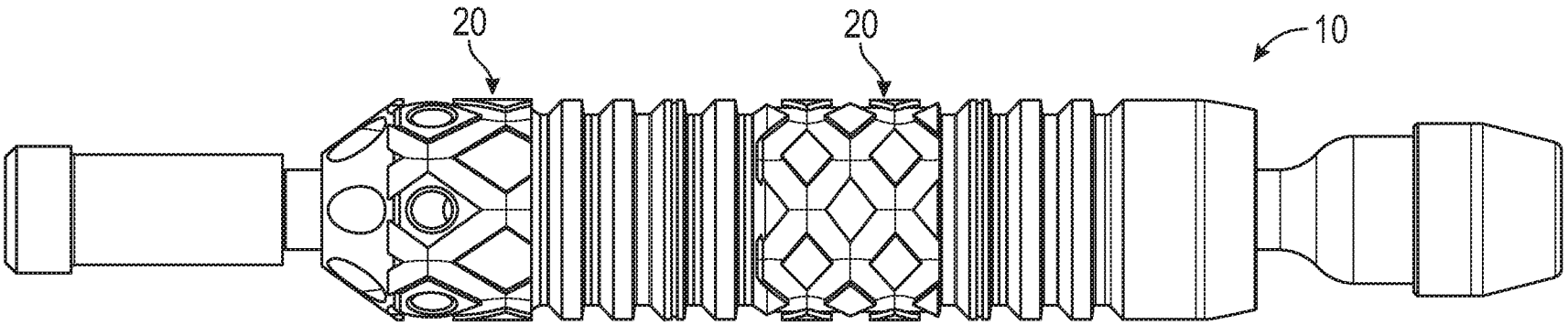

FIGS. 7 to 11 illustrate pad type plungers 10 that include one or more scraping features 20 in accordance with one or more embodiments of the disclosure. FIGS. 12 to 14B illustrate sliding sleeve plungers 10 that include one or more scraping features 20 in accordance with one or more embodiments of the disclosure. As shown in FIGS. 12 and 13, the plunger 10 may include, for example, three or more areas which include scraping feature 20. Alternatively, the plunger may include two or more areas which include scraping feature 20, as shown in FIGS. 7, 10, 14A, and 14B. In another embodiment, the plunger may include a scraping feature 20 at one end of the plunger 10, which may be varied in length, as shown in FIGS. 8, 9, and 11.

As shown in the example embodiments of FIGS. 5A to 14B, the scraping features 20 may be located at one or more locations along a length of the plunger 10 and/or may extend along substantially an entire length of the plunger 10. For example, the scraping feature 20 may be included on at least one of a valve cage, a main body, a pad, and/or a tail piece of the plunger 10 (as shown, for example, in FIG. 1A), but a location of the scraping feature 20 is not limited to these examples. The location may be chosen according to the intended application and/or environment that the plunger 10 is to be implemented. For example and without limitation, the scraping feature 20 may be located on the valve cage and/or the tail piece 11 of the plunger 10 such that an initial contact surface of the plunger 10 with the tubing interior may include the scraping feature 20 (e.g., FIGS. 5A to 5D). In other examples, the scraping feature 20 may be located on a spring loaded pad section 12 of the plunger 10 (e.g., FIG. 10), which is biased outwardly against an inner wall of the well tubing to facilitate contact with well tubing that has deviations in size and/or shape.

In an example embodiment, a method for scraping material (e.g., paraffins) from a tubular body may include releasing the plunger 10 within a tubular body, the plunger 10 having a body with an outer surface and at least one scraping feature 20 located on the outer surface, the scraping feature including at least one ridge 50. The at least one ridge 50 is configured to scrape the material from an inner surface of the tubular body and direct the scraped material away from the plunger body. The scraped material may flow through the grooves 40 which may be located on a circumferential side of the at least one ridge 50.

By implementing the scraping feature 20 of the present disclosure, the associated apparatus, e.g., plunger, pig, etc., may scrape the tubing sidewalls while ascending and/or descending to clean and prevent buildup of solids in the tubing. The scraping feature 20 may also improve operation of the associated apparatus and maintain and/or restore well production.

Conditional language, such as, "can," "could," "might," or "may," unless specifically stated otherwise, or otherwise understood within the context as used, is generally intended to convey that certain implementations could, but do not necessarily, include certain features and/or elements while other implementations may not. Thus, such conditional language generally is not intended to imply that features and/or elements are in any way required for one or more implementations or that one or more implementations necessarily include these features and/or elements. It is also intended that, unless expressly stated, the features and/or elements presented in certain implementations may be used in combination with other features and/or elements disclosed herein.

The specification and annexed drawings disclose examples embodiments of the present disclosure. The examples illustrate various features of the disclosure, but those of ordinary skill in the art will recognize that many further combinations and permutations of the disclosed features are possible. Accordingly, various modifications may be made to the disclosure without departing from the scope or spirit thereof. Further, other embodiments may be apparent from the specification and annexed drawings, and practice of disclosed embodiments as presented herein. Examples disclosed in the specification and the annexed drawings should be considered, in all respects, as illustrative and not limiting. Although specific terms are employed herein, they are used in a generic and descriptive sense only, and not intended to the limit the present disclosure.

What is claimed is:

1. A plunger lift apparatus, comprising:

a plunger having a body with an outer surface;

at least one sealing feature on the body comprising a plurality of seals alternating with a plurality of recesses; and at least one scraping feature formed integrally with the outer surface and disposed along a length of the body, wherein each scraping feature includes a plurality of ridges and a plurality of grooves between the ridges, wherein the ridges are configured to scrape material from an inner surface of a tubular body, wherein each ridge includes leading and trailing edges, wherein at least a portion of each of the leading and trailing edges of the ridges forms at least one of an acute or an obtuse angle with respect to bottom surfaces of the adjacent grooves and wherein a maximum height of a first ridge in a radial direction of the body is different from a maximum height of a second adjacent ridge in the radial direction.

2. The plunger lift apparatus of claim 1, wherein the leading and trailing edges of the ridges face in a forward direction of travel or a rearward direction of travel of the plunger, the forward direction of travel and the rearward direction of travel being along a longitudinal axis of the plunger.

3. The plunger lift apparatus of claim 1, wherein the ridges have at least one of a U, V, W, circular, oval, or diamond shape.

4. The plunger lift apparatus of claim 1, wherein at least one ridge has an outer surface with a height in the radial direction that is greater than a height of other portions of the outer surface of the plunger.

5. The plunger lift apparatus of claim 1, wherein the leading and trailing edges of the ridges are concave in shape.

6. The plunger lift apparatus of claim 1, wherein at least a portion of the leading and trailing edges of the ridges form an acute angle with respect to the bottom surfaces of adjacent grooves.

7. The plunger lift apparatus of claim 1, wherein top surfaces of at least some of the ridges have a height in the radial direction that varies along the length of the body.

8. The plunger lift apparatus of claim 1, wherein a first portion of the leading and trailing edges of the ridges are straight and wherein a second portion of the leading and trailing edges of the ridges are concave.

9. The plunger lift apparatus of claim 1, wherein a first portion of the leading and trailing edges of the ridges form an acute angle with respect to the bottom surfaces of adjacent grooves and wherein a second portion of the leading and trailing edges of the ridges form an obtuse angle with respect to the bottom surfaces of adjacent grooves.

10. The plunger lift apparatus of claim 1, wherein the at least one scraping feature comprises first and second scraping features that are located on opposite sides, respectively, of the at least one sealing feature.

11. The plunger lift apparatus of claim 9, wherein the first and second portions of the leading and trailing edges of the ridges are both straight.

12. A method for scraping material from a tubular body, comprising: releasing a plunger within the tubular body, the plunger having a body with an outer surface, at least one sealing feature on the body comprising a plurality of seals alternating with a plurality of recesses, and at least one scraping feature formed integrally with the outer surface and disposed along a length of the body, wherein each scraping feature includes a plurality of ridges and a plurality of grooves between the ridges, wherein the ridges are configured to scrape material from an inner surface of the tubular body, wherein each ridge includes leading and trailing edges, wherein at least a portion of each of the leading and trailing edges of the ridges forms at least one of an acute or a obtuse angle with respect to bottom surfaces of the adjacent grooves and wherein a maximum height of a first ridge in a radial direction of the body is different from a maximum height of a second adjacent ridge in the radial direction.

13. The method of claim 12, wherein leading and trailing edges of the ridges face in a forward direction of travel or a rearward direction of travel of the plunger, the forward direction of travel and the rearward direction of travel being along a longitudinal axis of the plunger.

14. The method of claim 12, wherein the ridges have a U, V, W, circular, oval, or diamond shape.

15. The method of claim 12, wherein at least one ridge has an outer surface with a height that is greater than a height of other portions of the outer surface of the plunger.

16. The method of claim 12, wherein the leading and trailing edges of the ridges are concave in shape.

17. The method of claim 12, wherein at least a portion of the leading and trailing edges of the ridges form an acute angle with respect to the bottom surfaces of adjacent grooves.

18. The method of claim 12, wherein top surfaces of at least some of the ridges have a height in the radial direction that varies along the length of the body.

19. The method of claim 12, wherein a first portion of the leading and trailing edges of the ridges are straight and wherein a second portion of the leading and trailing edges of the ridges are concave.

20. The method of claim 12, wherein a first portion of the leading and trailing edges of the ridges form an acute angle with respect to bottom surfaces of adjacent grooves and wherein a second portion of the leading and trailing edges of the ridges form an obtuse angle with respect to bottom surfaces of adjacent grooves.

21. The method of claim 12, wherein the at least one scraping feature comprises first and second scraping features that are located on opposite sides, respectively, of the at least one sealing feature.

22. The method of claim 20, wherein the first and second portions of the leading and trailing edges of the ridges are both straight.

* * * * *